US011404033B1

(12) United States Patent
Bergin

(10) Patent No.: US 11,404,033 B1
(45) Date of Patent: Aug. 2, 2022

(54) SUPPLEMENTAL COMPENSATING SADDLE FOR CLASSICAL GUITAR

(71) Applicant: Thomas Bergin, Leawood, KS (US)

(72) Inventor: Thomas Bergin, Leawood, KS (US)

( * ) Notice: Subject to any disclaimer, the term of this patent is extended or adjusted under 35 U.S.C. 154(b) by 0 days.

(21) Appl. No.: 17/243,905

(22) Filed: Apr. 29, 2021

(51) Int. Cl.
*G10D 3/12* (2020.01)
*G10D 1/08* (2006.01)

(52) U.S. Cl.
CPC ..... *G10D 3/12* (2013.01); *G10D 1/08* (2013.01)

(58) Field of Classification Search
CPC .. G10D 3/12; G10D 3/00; G10D 1/08; G10D 1/00
See application file for complete search history.

(56) References Cited

U.S. PATENT DOCUMENTS 4,208,941 A 6/1980 Wechter
4,625,613 A 12/1986 Steinberger
5,295,427 A 3/1994 Johnsen
5,600,078 A 2/1997 Edwards
5,705,760 A 1/1998 Rose
7,563,968 B2 7/2009 Medas
8,940,986 B1 1/2015 Edwards
9,899,008 B1 2/2018 Williams
10,497,342 B2 12/2019 Oberg
11,074,893 B1 * 7/2021 Zorich ..... G10D 3/12

* cited by examiner

*Primary Examiner* — Kimberly R Lockett
(74) *Attorney, Agent, or Firm* — Volte Law Group

(57) ABSTRACT

An article of manufacture for providing a supplemental compensating saddle used with a classical guitar having a head, a neck, a sound board, a bridge, a saddle, and a set of strings running from the head to the bridge. The supplemental compensating saddle includes a mounting bracket having a higher rear vertical member and a lower front vertical member coupled together, the mounting bracket being mounted behind the bridge, a set of node assemblies coupled to the higher rear vertical member and extending across the bridge and under the set of strings, each of the node assemblies supporting a corresponding string within the set of strings, and a set of adjustable securing mechanisms coupling each of the node assemblies to the higher rear member of the mounting bracket, each adjustable securing mechanism enables each corresponding node assembly to move parallel to a path of the corresponding string within the set of strings.

8 Claims, 4 Drawing Sheets

Compensating saddle

Compensating saddle mounted on Guitar

Compensating saddle mounted on Guitar

SUPPLEMENTAL COMPENSATING SADDLE FOR CLASSICAL GUITAR

TECHNICAL FIELD

This application relates in general to an article of manufacture for providing improved musical instruments, and more specifically, to an article of manufacture providing a supplemental compensating saddle for a classical guitar.

BACKGROUND

All fretted string instruments have the same problem with staying in tune as the notes progress up the neck towards the bridge. This problem is referred to as "intonation" in this context. The act of fretting a note increases the tension and changes the pitch. The degree to which this happens depends on many factors string tension, thickness, weight, height, pressure, etc. Therefore, the vibrational node at the bridge, also called a saddle on an acoustic instrument, is not equidistant from the 12th fret, as the nut, and must be movable based on conditions as listed above in order to maintain perfect pitch along the full range of the neck. Almost all electric guitars have bridges that adjust for intonation.

The bridge on an electric guitar plays no part in the sound production as the sound is generated by the pickups sensing the electromagnetic variance caused by the string vibration. Acoustic guitars transmit the energy from the vibrating strings into the sound board via the bridge/saddle assembly. The shape, thickness, and structure of the sound board and body amplify the sound. Acoustic guitars do not have adjustable bridges because the bridge or saddle is the thing that transmits the energy to create the sound and extra weight of a mechanism would adversely impact the energy transfer, and because modifying the sound board and/or bridge to attach a mechanism would negatively impact the sound of the instrument as well as the aesthetics.

All classical guitars have a fixed saddle and therefore suffer from tuning issues high on the neck. Musicians must constantly worry about keeping their classical guitar in tune for all of the reasons explained above. Therefore, a need exists for an article of manufacture for providing a supplemental compensating saddle for a classical guitar. The present invention attempts to address the limitations and deficiencies in prior solutions according to the principles and example embodiments disclosed herein.

SUMMARY

In accordance with the present invention, the above and other problems are solved by providing an article of manufacture providing a supplemental compensating saddle for a classical guitar according to the principles and example embodiments disclosed herein.

In one embodiment, the present invention is an article of manufacture for providing a supplemental compensating saddle for a classical guitar. The supplemental compensating saddle may be used with a classical guitar having a head, a neck, a sound board, a bridge, a saddle, and a set of strings running from the head to the bridge. The supplemental compensating saddle includes a mounting bracket having a higher rear vertical member and a lower front vertical member coupled together, the mounting bracket being mounted behind the bridge, a set of node assemblies coupled to the higher rear vertical member and extending across the bridge and under the set of strings, each of the node assemblies supporting a corresponding string within the set of strings, and a set of adjustable securing mechanisms coupling each of the node assemblies to the higher rear member of the mounting bracket, each adjustable securing mechanism enables each corresponding node assembly to move parallel to a path of the corresponding string within the set of strings.

In another aspect of the disclosure, each node assembly includes a threaded end coupled to the higher rear vertical member of the mounting bracket and a string support end, and a node rod connecting the treaded end to the string support end of each node assembly. The string support end is configured to be oriented perpendicular to a corresponding string supported by the node assembly.

In another aspect of the disclosure, the mounting bracket comprises a set of mounting holes through the higher rear vertical member and a set of stringing holes through the lower front vertical member, each of the set of stringing holes are parallel to the corresponding mounting hole.

In another aspect of the disclosure, each adjustable securing mechanism within the set of adjustable securing mechanisms comprises a front nut and a rear nut, the front nut and rear nut being coupled on the threaded end of each node assembly positioned on both sides of the higher rear vertical member as the node assembly passes through one of the set of mounting holes through the higher rear vertical member.

In another aspect of the disclosure, each string of the set of strings are oriented to pass over the string support end of one of the node assemblies from the head to the bridge of the guitar.

In another aspect of the disclosure, rotating the front nut and rear nut adjusts a location of the string supporting end of the corresponding node assembly about the saddle.

In another aspect of the disclosure, supplemental compensating saddle uses 6 node assemblies for the classical guitar having 6 strings.

In another aspect of the disclosure, each string within the set of strings passes through one of the set of stringing holes when secured to the bridge.

The foregoing has outlined rather broadly the features and technical advantages of the present invention in order that the detailed description of the invention that follows may be better understood. Additional features and advantages of the invention will be described hereinafter that form the subject of the claims of the invention.

It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Referring now to the drawings in which like reference numbers represent corresponding parts throughout.

DETAILED DESCRIPTION

Figure 1:
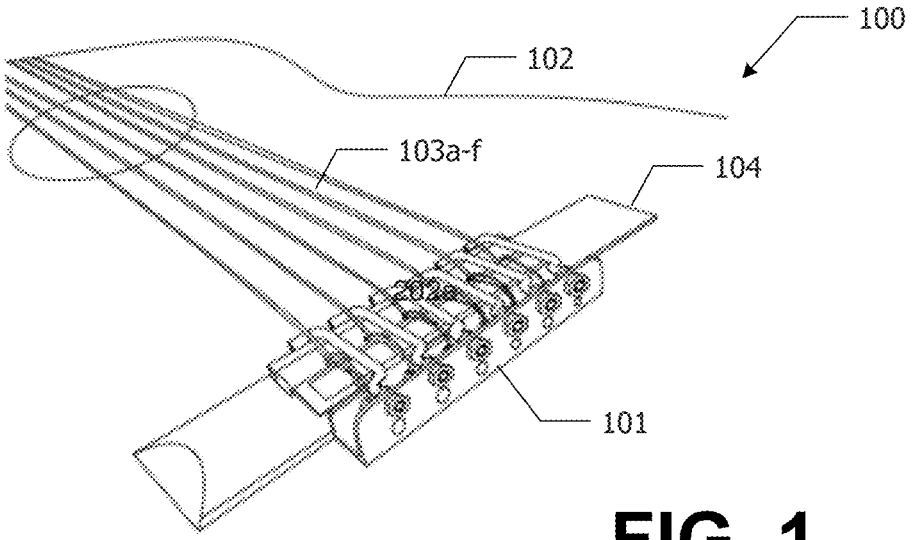
FIG. 1 illustrates a guitar having of an article of manufacture providing a supplemental compensating saddle for a classical guitar according to the present invention.

This application relates in general a system and method for providing improved musical instruments, and more specifically, to an article of manufacture for providing a supplemental compensating saddle for a classical guitar according to the present invention.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a," "an," and "the" include plural referents unless the context clearly dictates otherwise. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises," "comprising," "includes," and "including" specify the presence of stated features, steps or components, but do not preclude the presence or addition of one or more other features, steps or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

The terms "musician," and "user" refer to an entity, e.g., a human, a supplemental compensating saddle for a classical guitar associated with the invention. The term user herein refers to one or more users.

The term "invention" or "present invention" refers to the invention being applied for via the patent application with the title "Supplemental Compensating Saddle for a Classical Guitar." Invention may be used interchangeably with saddle In general, the present disclosure relates a system and method for providing a supplemental compensating saddle for a classical guitar. To better understand the present invention, FIG. 1 illustrates a guitar having of an article of manufacture providing a supplemental compensating saddle for a classical guitar according to the present invention.

The present invention is a compensating saddle 101 that does not require modifications the guitar 102. It is mounted to the bridge 104 through the act of stringing 103*a-f* the instrument 102. The number of strings may vary on classical guitars. As such, the present invention uses one node per string. The example embodiments of FIGS. 1-8 show a typical 6 string guitar for example proposed only. The number of nodes required by the present invention are not to be limited to these examples, except as recited within the attached claims.

The compensating saddle 101 may be added or removed with no impact or modification to the guitar 102. The compensating saddle 101 is comprised of a mounting bracket 201 that has holes that coincide with the string holes in the existing bridge. The guitar strings 103*a-f* pass through these holes to attach the bracket 201 firmly to the bridge 104. The compensating saddle 101 is not in contact with the sound board. One movable node assembly per string 202*a-f* is attached to the bracket 201. Each of the node assemblies 202*a-f* are shaped such as to allow for the clearance of the strings 103*a-f* as they are normally tied. Using the node assemblies 202*a-f*, the strings 103*a-f* may be easily adjusted by insertion of the compensating saddle 101 to address the problem of intonation.

Figure 2:
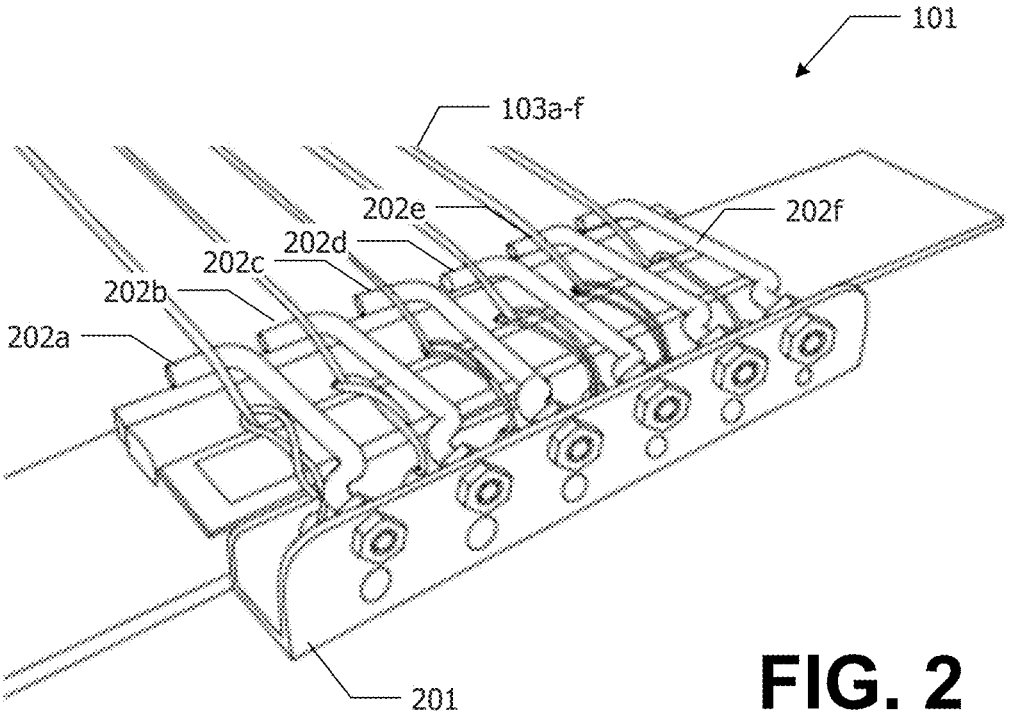
FIG. 2 illustrates an example embodiment of an article of manufacture providing a supplemental compensating saddle for a classical guitar according to the present invention.

FIG. 2 illustrates an example embodiment of an article of manufacture providing a supplemental compensating saddle for a classical guitar according to the present invention. The compensating saddle 101 is shown in detail in FIG. 2 having the mounting bracket 201 attached behind the bridge 104. The set of node assemblies 202*a-f* are coupled to the mounting bracket 201 and oriented under each string 103*a-f*. This compensating saddle 101 uses a replaceable saddle insert 106 that is lowered to account for the thickness of the movable nodes 202*a-f*. The node assemblies 202*a-f* are parallel to and in contact with the saddle and are free to move in a direction parallel to the length of the string. This movement of the node assemblies 202*a-f* changes the rear vibrational node relative to the frets and thus allows for maintaining pitch along the entire neck of the classical guitar 102. Each of these components and their respecting interaction with each other are described in additional detail below.

Figure 3:
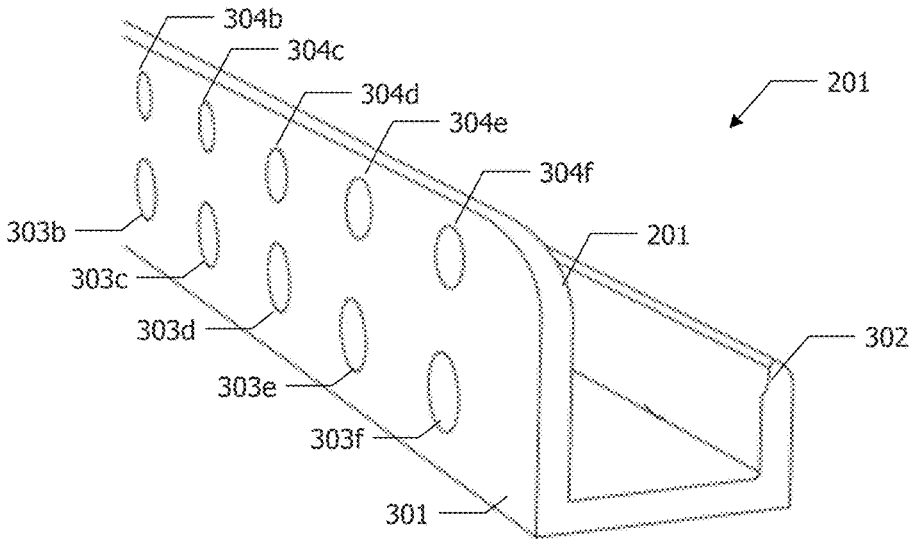
FIG. 3 illustrates a mounting bracket that is part of an article of manufacture for providing a supplemental compensating saddle for a classical guitar according to the present invention.

FIG. 3 illustrates a mounting bracket that is part of an article of manufacture for providing a supplemental compensating saddle for a classical guitar according to the present invention. The mounting bracket 201 comprises a U-shaped bracket having a higher rear vertical member 301 and a lower front vertical member 302 coupled together. A sets of mounting holes 304*a-f* are arranged in horizontally across the higher rear vertical member 301 passing through the rear member 301. A set of stringing holes 305*a-f* are present in the lower front vertical member 202, each stringing hole 305*a-f* being parallel to a corresponding mounting holes 304*a-f* through the rear vertical member 301. Each of these of mounting holes 304*a-f* and its corresponding stringing holes 305*a-f* correspond to each string 103*a-f* of the guitar 102.

Figure 4:
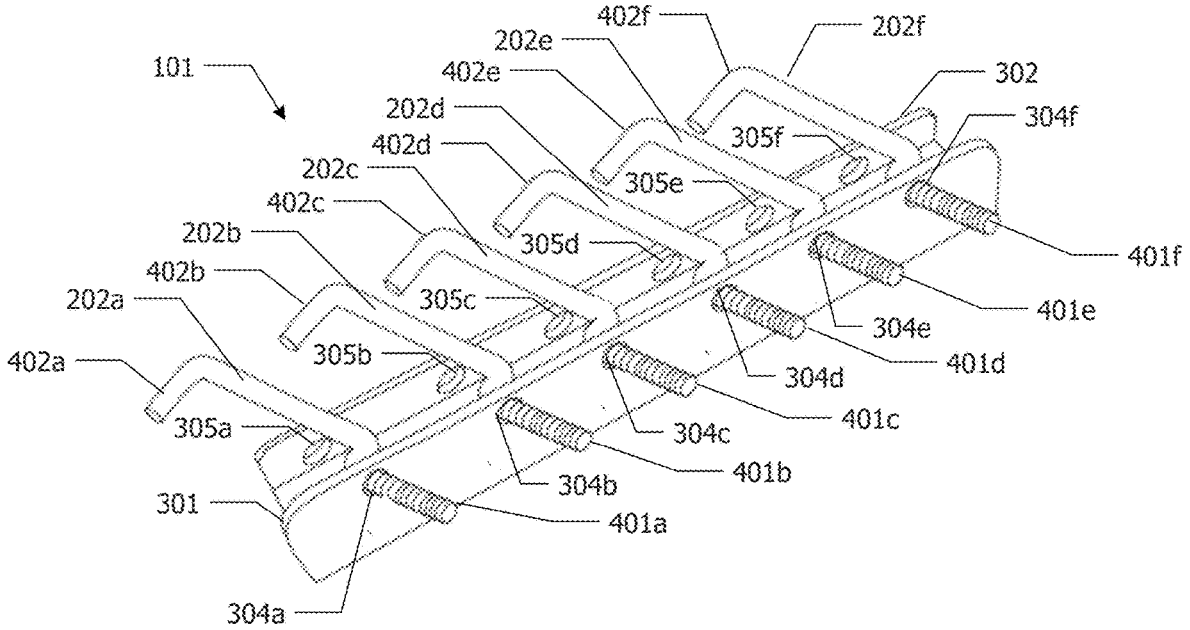
FIG. 4 illustrates a mounting bracket and a set of adjustable nodes that are part of an article of manufacture providing a supplemental compensating saddle fora classical guitar according to the present invention.
Figure 5:
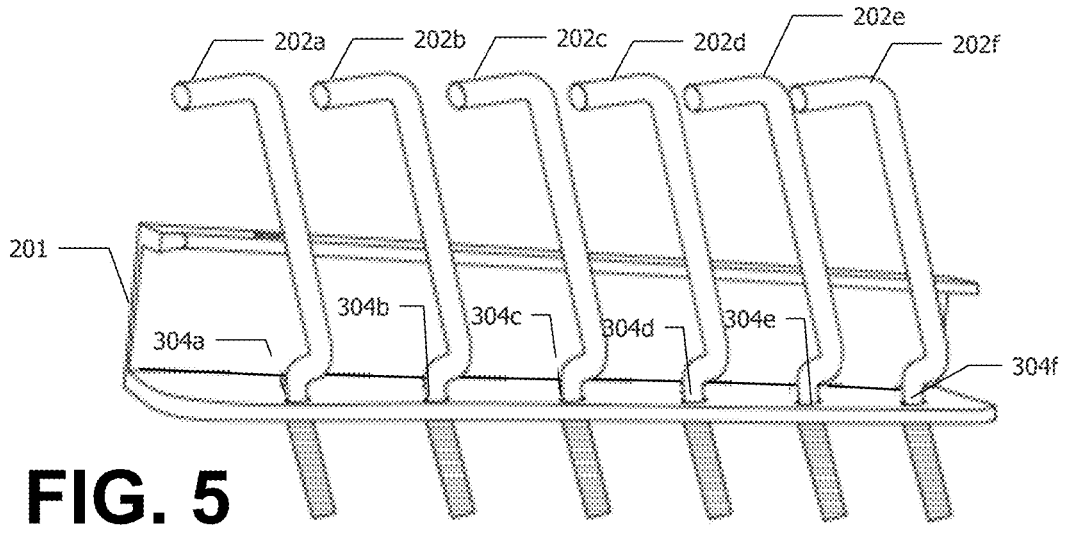
FIG. 5 illustrates a top view of a mounting bracket and a set of adjustable nodes that are part of an article of manufacture providing a supplemental compensating saddle for a classical guitar according to the present invention.

The mounting bracket is used to support the node assemblies 202*a-f* as shown in FIG. 4-5. The node assemblies 202*a-f* are coupled to the mounting bracket 201 with an adjustable securing mechanism. In a preferred embodiment, the adjustable securing mechanism is a pair of nuts 701*a-b*, as discussed in relations to FIG. 7 below. The mounting bracket 201 is typically 80 mm long and 13 mm on each side. Classical guitars normally have approximately 11 mm spacing on the strings. Therefore the length of the mounting bracket 201 for any particular guitar is dependent on the number of strings.

FIG. 4 illustrates a mounting bracket and a set of adjustable nodes that are part of an article of manufacture providing a supplemental compensating saddle for a classical guitar according to the present invention. FIG. 5 illustrates a top view of a mounting bracket and a set of adjustable nodes that are part of an article of manufacture providing a supplemental compensating saddle for a classical guitar according to the present invention. Each of the node assemblies 202*a-f* are inserted through one of the set of mounting holes 304*a-f* in the rear vertical member 301.

Each node assembly 202*a-f* has a threaded end 401*a-f* and a string support end 402*a-f* separated by a node rod 403*a-f*. The threaded end 401*a-f* of the node assemblies 202*a-f* are inserted into the set of mounting holes 304*a-f* in the rear vertical member 301. The threaded end 401*a-f* of the node assemblies 202*a-f* are configured to be oriented parallel to each of the corresponding string 103*a-f*. The string support end 402*a-f* is oriented to be perpendicular to the threaded end 401*a-f* of the node assemblies 202*a-f* to permit each string 103*a-f* to pass over each of the corresponding string support end 402*a-f*. The node assemblies 202-*f* are configured to be a single rod that bent into a configuration that orients the string support end 402*a-f* perpendicular and below each string 103*a-f* when the threaded end 401*a-f* of the node assemblies 202*a-f* are secured to the mounting bracket 201.

Figure 6A:
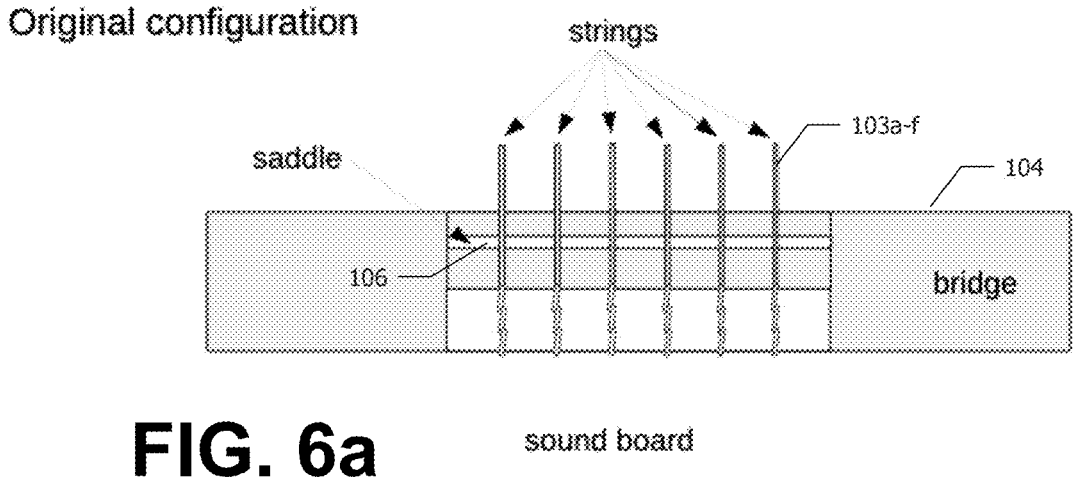
FIGS. 6*a-b* illustrate a top and a side view of classical guitar saddle and bridge with strings attached.
Figure 6B:
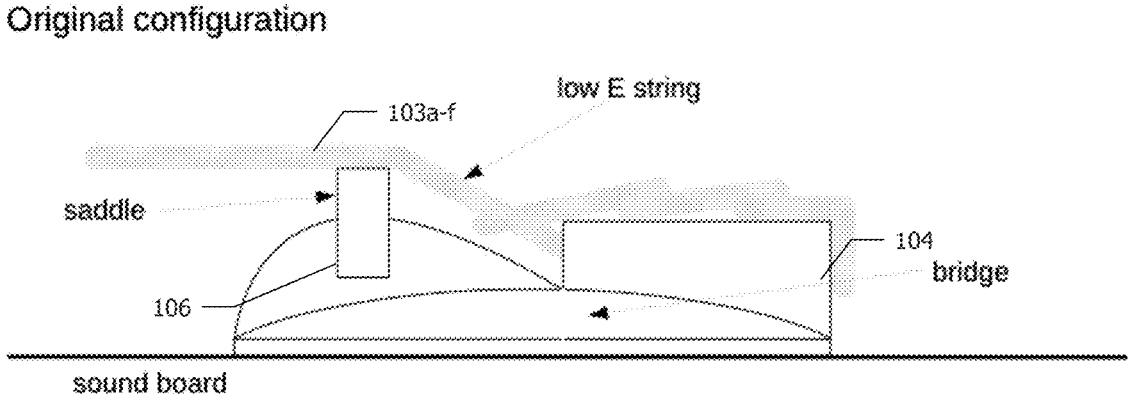

FIGS. 6*a-b* illustrate a top and a side view of classical guitar saddle and bridge with strings attached. The guitar 102 is shown in its original configuration in FIG. 6*a-b* without the compensating saddle 101 in place. The set of strings 103*a-f* are shown running across the saddle 106 and terminating at the rear edge of the bridge. The reconfigured guitar 102 is described below in reference to FIGS. 8*a-b*.

Figure 7A:
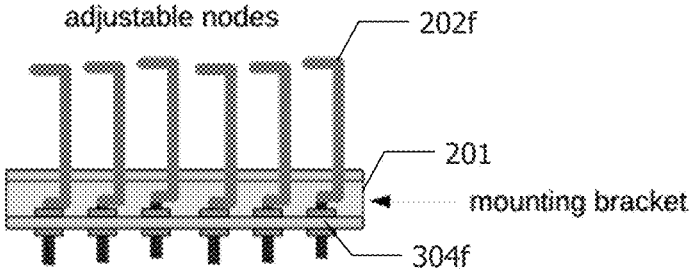
FIGS. 7*a-b* illustrate a top and a side view of an article of manufacture providing a supplemental compensating saddle fora classical guitar according to the present invention.
Figure 7B:
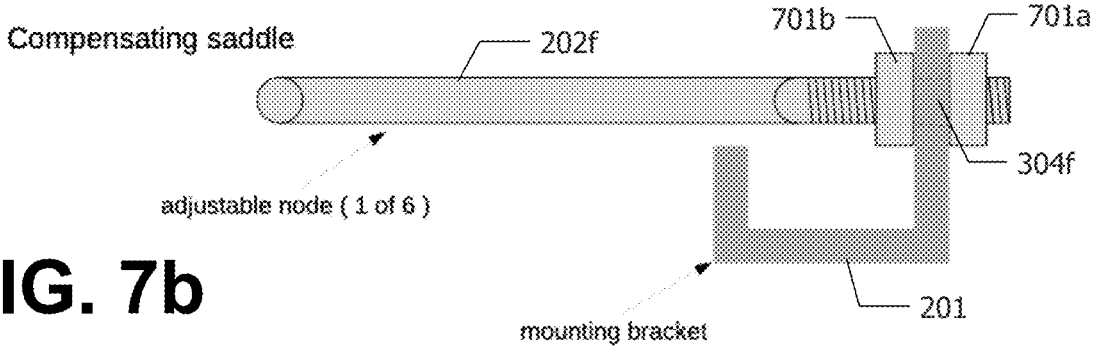

FIGS. 7*a-b* illustrate a top and a side view of an article of manufacture providing a supplemental compensating saddle for a classical guitar according to the present invention. The node assemblies 202*a-f* are shown coupled to the mounting bracket 201 and secured by a front nut 701*b* and a rear nut 701*a* that attach to the treaded end 401*a-f*. The front nut 701*b* is placed onto each of the node assemblies 202*a-f* before the threaded end 401*a-f* is inserted into the set of mounting holes 304*a-f* in the rear vertical member 301. When the threaded end 401*a-f* is inserted into the set of mounting holes 304*a-f* in the rear vertical member 301, the front nut 702*b* is adjacent to a front surface of the rear vertical member 301. The node assemblies are oriented to run over the front vertical member 302 and placing the string support end 402*a-f* perpendicular and below each string 103*a-f*. The rear nut 701*a* is added to each of the node assemblies 202*a-f* once the threaded end has passed through the set of mounting holes 304*a-f*. By tightening the front nut 701*b* and the rear nut 701*a* towards the rear vertical member 301, each of the node assemblies 202*a-f* are held securely in place. Each node assembly 202*a-f* is limited to the extent it may move by the dimensions of the saddle insert 106. The contact between the top of the saddle insert 106 and the bottom of the node assembly 202*a-f* defines the extreme forward and extreme backward positions. Typically, the movement will be about 3 mm.

To reposition a particular node assembly 202*a-f*, a user loosenz the nut 701*a-b* on the side opposite of the intended direction of travel. The nut on the same side of the intended direction of travel is then rotated until the particular node assembly 202*a-f* has moved the desired amount. The user then retightens the opposite nut to secure the particular node assembly 202*a-f* in its adjusted location. These adjustments may be made one node assembly 202*a-f* at a time as needed.

Figure 8A:
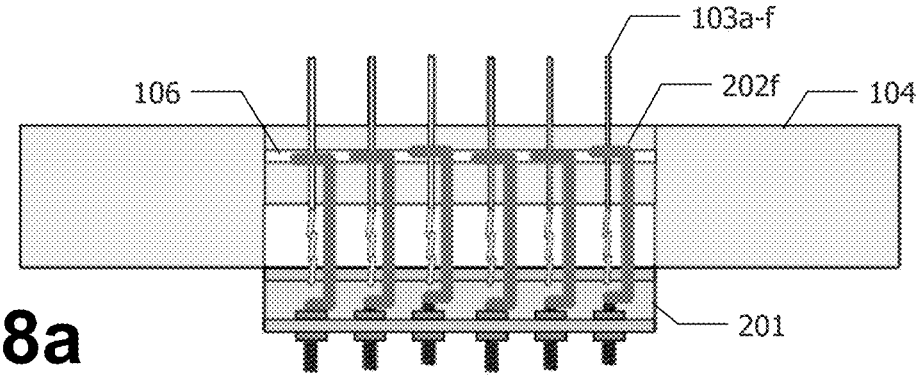
FIGS. 8*a-b* illustrate a top and a side view of an installed article of manufacture providing a supplemental compensating saddle for a classical guitar according to the present invention.
Figure 8B:
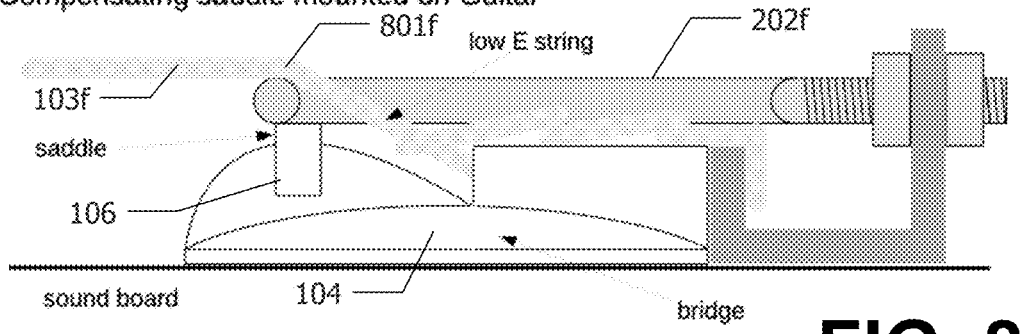

FIGS. 8*a-b* illustrate a top and a side view of an installed article of manufacture providing a supplemental compensating saddle for a classical guitar according to the present invention. The compensating saddle 101 is shown installed onto the guitar in FIG. 8*a-b*. Each string 103*a-f* is run over the string support end 402*a-f* of the node assemblies 202*a-f* as it rests on top of a saddle 106. The strings 103*a-f* engage the mounting bracket 201 and are terminated at the bridge 104 as originally configured. The string support end 402*a-f* of the node assemblies 202*a-f* acts as an adjustable saddle that may be individually adjusted for each of the strings 103*a-f*.

To install a compensating saddle 101, the user strings a guitar using the typical process with the exception of including the mounting bracket 201 while tying off the strings 202*a-f* on the bridge 104. Each string 202*a-f* is threaded through the bridge 104 of the guitar 102 and through corresponding hole 303*a-f* in the mounting bracket 201 and then a knot is tied. Before each string 202*a-f* is tightened, each node assembly 202*a-f* is placed under a corresponding string 202*a-f* and through the mounting hole 304*a-f* in the mounting bracket 201. Each node assembly 202*a-f* can be placed in a neutral position until the guitar 102 is tuned. For final tuning and fine adjustment of the intonation, each string 202*a-f* is tuned in the open position and at the $12_{th}$ fret (octave). The node assembly 202*a-f* is moved towards the $12_{th}$ fret to sharpen the $12_{th}$ fret tone and moved away to flatten the $12_{th}$ fret tone. Once installed, the fine tuning process is the same as with any compensating bridge.

Even though particular combinations of features are recited in the present application, these combinations are not intended to limit the disclosure of the invention. In fact, many of these features may be combined in ways not specifically recited in this application. In other words, any of the features mentioned in this application may be included to this new invention in any combination or combinations to allow the functionality required for the desired operations.

No element, act, or instruction used in the present application should be construed as critical or essential to the invention unless explicitly described as such. Further, the phrase "based on" is intended to mean "based, at least in part, on" unless explicitly stated otherwise.

What is claimed is:

1. An article of manufacture providing supplemental compensating saddle for a classical guitar, the classical guitar having a head, a neck, a sound board, a bridge, a saddle, and a set of strings running from the head to the bridge, the supplemental compensating saddle comprises:

a mounting bracket having a higher rear vertical member and a lower front vertical member coupled together, the mounting bracket being mounted behind the bridge;

a set of node assemblies coupled to the higher rear vertical member and extending across the bridge and under the set of strings, each of the node assemblies supporting a corresponding string within the set of strings; and a set of adjustable securing mechanisms coupling each of the node assemblies to the higher rear member of the mounting bracket, each adjustable securing mechanism enables each corresponding node assembly to move parallel to a path of the corresponding string within the set of strings.

2. The supplemental compensating saddle according to claim 1, wherein each node assembly comprises:

a threaded end coupled to the higher rear vertical member of the mounting bracket;

a string support end, the string support end configured to be oriented perpendicular to a corresponding string supported by the node assembly; and a node rod connecting the treaded end to the string support end of each node assembly.

3. The supplemental compensating saddle according to claim 2, wherein the mounting bracket comprises:

a set of mounting holes through the higher rear vertical member; and a set of stringing holes through the lower front vertical member, each of the set of stringing holes are parallel to the corresponding mounting hole.

4. The supplemental compensating saddle according to claim 3, wherein each adjustable securing mechanism within the set of adjustable securing mechanisms comprises a front nut and a rear nut, the front nut and rear nut being coupled on the threaded end of each node assembly positioned on both sides of the higher rear vertical member as the node assembly passes through one of the set of mounting holes through the higher rear vertical member.

5. The supplemental compensating saddle according to claim 4, wherein each string of the set of strings are oriented to pass over the string support end of one of the node assemblies from the head to the bridge of the guitar.

6. The supplemental compensating saddle according to claim 5, wherein rotating the front nut and rear nut adjusts a location of the string supporting end of the corresponding node assembly about the saddle.

7. The supplemental compensating saddle according to claim 1, wherein supplemental compensating saddle uses 6 node assemblies for the classical guitar having 6 strings.

8. The supplemental compensating saddle according to claim 4, wherein each string within the set of strings passes through one of the set of stringing holes when secured to the bridge.

* * * * *